US010414615B2

(12) United States Patent
Adami

(10) Patent No.: US 10,414,615 B2
(45) Date of Patent: Sep. 17, 2019

(54) SHEET STACKER AND METHOD FOR FORMING STACKS OF SHEETS CONTAINING DIFFERENT JOBS OF SHEETS

(71) Applicant: FOSBER S.P.A., Pescaglia (IT)

(72) Inventor: Mauro Adami, Viareggio (IT)

(73) Assignee: Fosber S.p.A., Pescaglia (IT)

( * ) Notice: Subject to any disclaimer, the term of this patent is extended or adjusted under 35 U.S.C. 154(b) by 0 days.

(21) Appl. No.: 15/923,276

(22) Filed: Mar. 16, 2018

(65) Prior Publication Data

US 2018/0273332 A1 Sep. 27, 2018

(30) Foreign Application Priority Data

Mar. 22, 2017 (EP) ..... 17162291

(51) Int. Cl.

| | |
|---|---|
| ***B65H 29/50*** | (2006.01) |
| ***B65H 31/28*** | (2006.01) |
| ***B65H 29/18*** | (2006.01) |
| ***B65H 31/36*** | (2006.01) |
| ***B65H 33/08*** | (2006.01) |
| ***B65H 29/14*** | (2006.01) |
| ***B65H 31/10*** | (2006.01) |

(Continued)

(52) U.S. Cl.

CPC ..... *B65H 29/50* (2013.01); *B65H 29/14* (2013.01); *B65H 29/18* (2013.01); *B65H 31/10* (2013.01); *B65H 31/20* (2013.01); *B65H 31/28* (2013.01); *B65H 31/3054* (2013.01); *B65H 31/36* (2013.01); *B65H 33/08* (2013.01); *B65H 31/02* (2013.01); *B65H 2301/141* (2013.01); *B65H 2301/3611* (2013.01); *B65H 2301/42194* (2013.01); *B65H 2301/42264* (2013.01); *B65H 2405/1122* (2013.01); *B65H 2511/10* (2013.01); *B65H 2511/20* (2013.01); *B65H 2701/1762* (2013.01)

(58) Field of Classification Search

CPC ..... B65H 29/18; B65H 33/08; B65H 29/50; B65H 31/02; B65H 31/26; B65H 31/3054; B65H 31/36; B65H 2301/42194; B65H 2301/42264; B65H 2301/3611; B65H 2301/36112

See application file for complete search history.

(56) References Cited

U.S. PATENT DOCUMENTS 1,650,535 A * 11/1927 Parsons ..... B41K 3/102 101/483

4,273,325 A 6/1981 Rodewald (Continued)

FOREIGN PATENT DOCUMENTS

| | | |
|---|---|---|
| CN | 202414847 U | 9/2012 |
| CN | 203255778 U | 10/2013 |
| CN | 204057396 U | 12/2014 |

*Primary Examiner* — Jeremy R Severson

(74) *Attorney, Agent, or Firm* — Breiner & Breiner, L.L.C.

(57) ABSTRACT

A sheet stacker includes a sheet conveyor arrangement and a stacker platform. The sheets are fed in a sheet feeding direction on the stacker platform, to form stacks of sheets thereon. The stacker platform supports a stack conveyor configured and controlled to move in a conveyor direction to move the stack under formation such that sequentially piled up jobs are placed in an approximately centered position one with respect to the other according to the sheet feeding direction.

16 Claims, 15 Drawing Sheets

(51) Int. Cl.

| | |
|---|---|
| ***B65H 31/20*** | (2006.01) |
| ***B65H 31/30*** | (2006.01) |
| *B65H 31/02* | (2006.01) |

(56) References Cited

U.S. PATENT DOCUMENTS

| | | | | | |
|---|---|---|---|---|---|
| 5,664,767 | A * | 9/1997 | Voss | B65H 31/32 | 271/189 |
| 5,829,951 | A * | 11/1998 | Adami | B65H 29/66 | 414/789 |
| 2009/0169351 | A1* | 7/2009 | Wu | B65H 29/18 | 414/791.2 |
| 2013/0161895 | A1* | 6/2013 | Lin | B65H 29/14 | 271/69 |
| 2014/0353119 | A1* | 12/2014 | Wu | B65G 57/112 | 198/431 |
| 2018/0099833 | A1* | 4/2018 | Talken | B65H 29/18 | |

* cited by examiner

SHEET STACKER AND METHOD FOR FORMING STACKS OF SHEETS CONTAINING DIFFERENT JOBS OF SHEETS

FIELD OF THE INVENTION

The invention relates to sheet stacking devices and methods, useful for forming stacks of sheets, such as, but not limited to, corrugated board sheets. Specifically, embodiments disclosed herein concern sheet stackers and stacking methods suitable for the formation of sheet stacks containing multiple sheet orders.

BACKGROUND OF THE INVENTION

In the paper industry, corrugated board sheets are manufactured starting from a continuous corrugated board material, which is slit longitudinally and divided into strips. Each strip is further divided transversely to generate a plurality of sheets of desired length. Sheets thus obtained are delivered to a so-called stacker, which forms stacks or bundles of sheets. The stacks are subsequently delivered to the final user, for example for the manufacturing of corrugated board boxes or the like.

Corrugated board web is usually formed by a combination of at least one flat paper web and at least one fluted paper web. Fluted paper webs are usually obtained by corrugating a flat paper web between corrugator rollers meshing with each another. Usually, a cardboard web comprises at least one fluted paper web arranged between two flat paper webs, known also as "liners". The liners are glued to the fluted paper web by means of glue applied to the crests of the flutes of the fluted paper web. Sometimes a cardboard web comprises more than just one fluted paper web. Intermediate liners are in this case arranged between two fluted paper webs. The flutes of the fluted paper webs may differ in terms of flute pitch and/or flute dimension. Different flutes are used to impart different mechanical properties to the final corrugated board sheet.

Fast advancing sheets must be carefully piled up to form stacks of regular shape. Known sheet stackers usually comprise a sheet conveyor arrangement which receives a substantially continuous flow of sheets which are shingled and delivered onto a stacking surface in a stacking bay.

In some cases, each stack is formed by staggered bundles, each bundle containing a predetermined number of sheets. TW-M423688U, US2014/0353119 and US2009/0169351 disclose sheet stackers configured and controlled for forming stacks of mutually staggered bundles of corrugated board sheets. In order to mutually stagger neighboring bundles of the stack, said stack is formed on a horizontally movable stacker platform. The reciprocating staggering motion is in a direction substantially parallel to the feeding direction of the corrugated board sheets. The stacker platform comprises a conveyor belt, forming a stacking surface. The conveyor belt has a horizontal conveying motion, orthogonal to the reciprocating staggering motion of the stacker platform. The conveyor belt is used to evacuate the formed stack from the stacking bay according to an evacuation direction which is substantially orthogonal to the direction of arrival of the corrugated board sheets in the stacking bay. Each bundle of a stack is formed against a single stop plate or a dual stop plate, which are arranged in two positions which are staggered along the direction of arrival of the corrugated board sheets. Staggering of neighboring bundles is obtained by means of a reciprocating motion of the stacker platform in a horizontal direction. Moving the entire stacker platform is difficult and requires strong actuators and a particularly sturdy structure.

CN204057396U and CN203255778U disclose further embodiments of stackers designed and configured for producing stacks of sheets, each formed by a plurality of staggered bundles. Staggering is obtained by using two mutually spaced apart stop plates. The distance between the stop plates is equal to the staggering of neighboring bundles. In addition to moving the stop plates, the sheet discharge end of the sheet conveyor must also be reciprocatingly moved back and forth in a direction parallel to the feeding direction, to achieve correct staggering of adjacent bundles.

In other known sheet stackers, smooth stacks are formed, as disclosed e.g. in U.S. Pat. No. 4,273,325.

U.S. Pat. No. 5,829,951 discloses an up-stacker, i.e. a sheet stacker wherein the stacks are formed on a stationary stacker platform, and wherein a sheet conveyor arrangement is provided having a downstream sheet discharge end, wherefrom the sheets are discharged onto the stack being formed, moves gradually upwards as the stack grows vertically. This known stacker is suitable for the formation of small stacks or bundles of sheets.

One of the critical aspects of sheet stackers is the transient phase of removing the formed stack from the stacking bay. Removing the stack requires a gap to be formed in the otherwise continuous flow of sheets delivered by the sheet conveyor arrangement to the stacking bay. The longer the time required for removing a just formed stack of sheets from the stacking bay, the larger the gap required in the sheet flow. This transient phase slows down the operation of the sheet stacker and thus adversely affects the production rate thereof. Also, forming a large gap in the sheet flow can be difficult.

Corrugated board sheets are produced according to jobs. Each job contains a certain number of identical cardboard sheets. A job may include a large number of sheets, e.g. several tens or even hundreds of sheets, which may form one or several identical stacks.

In some cases, however, smaller jobs must be processed. For instance small jobs containing just some tens of sheets are sometimes requested. Jobs may differ from one another with respect to the kind of liners and fluted paper webs used, as well as with respect to the dimensions of the sheets. While usually a stack includes identical sheets of the same job, in some circumstances it may be beneficial to collect different jobs on one and the same stack, in order to save space along the conveyors and in the storage areas. When different jobs are stacked in the same stack, each job is formed by a bundle of identical sheets. Stacked bundles may be formed by sheets of different length, such that one job may overhangingly project from the previous job or from the next job in the stack. This may prejudice the stability of the stack. The difference in length between sheets of jobs collected on the same stack cannot be larger than a given amount, to prevent the stack from collapsing. This poses limits on the possibility of stacking different jobs on the same stack.

A need therefore exists, to provide sheet stackers and methods which overcome or at least partly alleviate one or more of the drawbacks of known stackers and stacking methods.

SUMMARY OF THE INVENTION

According to the invention a sheet stacker is provided comprising a sheet conveyor arrangement, configured for feeding a plurality of sheets in succession in a sheet feeding direction, said sheet conveyor arrangement having a sheet discharge end. The sheet stacker further comprises a stacker platform, whereon sheets delivered by the sheet conveyor arrangement are fed in a sheet feeding direction and formed into stacks. The sheet discharge end of the sheet conveyor arrangement and the stacker platform are provided with a mutual approaching and distancing movement. Moreover, the stacker platform comprises a stack conveyor which is controlled to move according to a conveyor direction.

According to embodiments disclosed herein, the conveyor direction is approximately parallel to a sheet feeding direction, i.e. to the direction according to which the sheets are fed onto the stacker platform. The stack conveyor is configured and controlled to move a partially formed stack in the conveyor direction, such that, when two jobs of different length in the conveyor direction are placed one onto the other, a shorter one of said two jobs is placed in an intermediate position with respect to a longer one of said two jobs. I.e. if for instance a subsequent job of sheets is shorter than a previously processed job, the subsequent job is positioned onto the previous job of sheets, which has already been formed in the stack, in an intermediate position of the previous job of sheets. As used herein, an intermediate position of one job with respect to another job means that one of said jobs (the longer one, in the conveyor direction) projects in an overhanging manner on both sides from the other job (the shorter one in the conveyor direction), i.e. on the leading side and on the trailing side of the job. The leading side of the job is the most downstream side of the job with respect to the conveyor direction, i.e. with respect to the direction according to which the sheets are fed on the stack. The trailing side of the job is the side most upstream side of the job with respect to the conveyor feeding direction.

Unless differently indicated, the length of a job and the length of a sheet is understood herein as the job dimension and the sheet dimension in the sheet feeding direction. Thus, a longer sheet is a sheet which has a longer dimension in the sheet feeding direction.

Thus, according to some embodiments, a stacker is provided, including: a sheet conveyor arrangement, configured for feeding a plurality of sheets in succession towards a sheet discharge end of said sheet conveyor arrangement; a stacker platform, whereon sheets delivered by the sheet conveyor arrangement are formed into stacks; wherein the sheet discharge end and the stacker platform are provided with a mutual approaching and distancing movement; a stack conveyor supported by the stacker platform, controlled to move according to a conveyor direction. The conveyor moves in a conveyor direction which is approximately parallel to a sheet feeding direction according to which sheets are fed onto the stacker platform. Moreover, the stack conveyor is configured and controlled to move a partially formed stack in said conveyor direction, such that a subsequent job of sheets is positioned onto a previous job of sheets in an intermediate position of the previous job of sheets.

As will become apparent from the following detailed description of exemplary embodiments, the above described arrangement gives the possibility of stacking jobs having variable lengths in the sheet feeding direction with a very simple stacker structure and with a limited number of adjustment movements required when moving from one job to the other.

According to preferred embodiments, the stack conveyor is configured and controlled to perform an evacuation motion in the conveyor direction, to remove a stack from the stacker platform.

In currently less preferred embodiments, the stack conveyor may be provided with an evacuation motion which is orthogonal to the sheet feeding direction. In this case evacuation can for instance be performed laterally, i.e. with a movement of the formed stack in a direction orthogonal to the direction according to which consecutively stacked jobs have been staggered one with respect to the other. The above mentioned double movement in two approximately orthogonal directions can be obtained e.g. with a compound conveyor, which may be configured to selectively move the stack in a first direction, substantially parallel to the sheet feeding direction, and in a second direction, substantially orthogonal to the sheet feeding direction, according to which the sheets are placed on the stacking platform.

Evacuation in the same job staggering direction is preferred since results in faster processing of the jobs and simpler structure of the stacker.

According to some embodiments, the stack conveyor and the sheet conveyor arrangement can be controlled and arranged to stack subsequent jobs of sheets, having a variable length in the sheet feeding direction, such that a job of longer sheets project from a job of shorter sheets on both sides of the stack in the sheet feeding direction (i.e. upstream and downstream of the job of shorter sheets), without a need to adjust the position of the sheet discharge end in the sheet feeding direction. Stacking of jobs of sheets having differing lengths is thus made easier. Stable stacks of different jobs can be formed without the need for complex adjusting movements of the sheet conveyor arrangement when switching from one job to the other. The structure and control of the stacker become simpler. Moreover, advantages can also be achieved in terms of speedy clearing of the stacker platform upon completion of a stack, since evacuation of a stack in a direction parallel to the sheet feeding direction, and preferably discordant thereto, can be fast.

A "job of sheets" as used herein may be understood as a group or set of sheets having certain common features. A job of sheets can, for instance be a set of identical sheets. A partially formed stack as used herein may be understood as a stack which contains less than the total number of sheets and jobs of sheets which form the complete stack.

An "intermediate position" of a subsequent job with respect to a previous job of sheets as used herein may be understood as any position wherein the trailing end and leading end of the subsequent job are distanced from both the trailing end and the leading end of the previous job. The trailing end and the leading end of a job as used herein indicate the most upstream and the most downstream edge of a job according to the sheet feeding direction. The sum of the distance between the respective trailing edges and the distance between the respective leading edges of two superimposed jobs represents the difference between the lengths of the sheets of the two jobs in the sheet feeding direction.

The distance between the respective trailing edges of two superimposed jobs may be different from the distance between the respective leading edges of said two superimposed jobs. It may however be beneficial to center the two jobs one with respect to the other, such that the two center lines thereof are coincident and consequently the distance between the respective trailing edges is substantially identical to the distance between the leading edges. A "center line" as used herein may be understood as the line which divides the sheets of a job in two symmetrical portions according to the sheet feeding direction.

As will become clearer from the following detailed description of exemplary embodiments, the conveyor direction can be parallel and concordant and alternatively parallel and opposite to the sheet feeding direction.

According to some embodiments, the stacker platform can be provided with a vertical lifting and lowering movement with respect to a stationary supporting structure and can be controlled to move gradually downwards while a stack of sheets is formed thereon. The sheet stacker will then be configured as a so-called down-stacker. The sheet discharge end of the sheet conveyor arrangement is thus not required to be vertically moved to accommodate the growing stack.

In further embodiments, the sheet conveyor arrangement may be configured such that the sheet discharge end thereof is gradually lifted in order to accommodate the growing stack, while the stacker platform is stationary. In this case the stacker is configured as a so-called up-stacker. In yet further embodiments, a lifting movement of the sheet discharge end of the sheet conveyor arrangement and a lowering movement of the stacker platform can be combined to accommodate the growing stack.

In particularly advantageous embodiments the evacuation motion of said stack conveyor can be oriented such that a completed stack is moved from the stacker platform onto an evacuation conveyor positioned under the sheet conveyor arrangement. The evacuation motion is thus parallel and opposite to the sheet feeding direction. The stacker is then preferably a down-stacker. The possibility of evacuating the stack in the opposite direction, i.e. by moving it parallel and concordant with the sheet feeding direction is not excluded.

To provide a neater stack of sheets, the stacker can comprise a stop plate, positioned above the stacker platform and arranged and configured for stopping the sheets delivered by the sheet conveyor arrangement onto the stacker platform. In some embodiments the stop plate can have a reciprocating vertical movement, which is synchronized with the motion of the stack conveyor in the conveyor direction to position sequentially superposed jobs of variable length on the same stack.

According to some embodiments an actuator can be provided, which controls a lifting and lowering movement of the sheet discharge end. The lifting and lowering movement can be synchronized with the motion of the stack conveyor in the conveyor direction to position sequentially superposed jobs of variable length.

For a more regular and orderly piling up of the sheets, according to some embodiments the sheet discharge end can be combined with a sheet retaining device, which is configured and arranged for retaining the top-most job of a stack being formed when the stack conveyor performs a motion in a direction away from the sheet discharge end to position the subsequent job on the previous job.

According to a further aspect, disclosed herein is a method of forming a stack of sheets comprising a plurality of superposed jobs. According to embodiments disclosed herein, the method comprises the following steps:

(a) feeding a plurality of sheets along a sheet conveyor arrangement towards a stacker platform, the sheet conveyor arrangement having a sheet discharge end, wherefrom the sheets are discharged onto the stacker platform in a sheet feeding direction and formed into a stack on a stack conveyor supported by the stacker platform; said stack conveyor movable in a conveyor direction parallel to the sheet feeding direction;

(b) while the sheet stack gradually grows on the stack conveyor, moving the stacker platform and the sheet discharge end gradually away from each other to increase the distance between the stacker platform and the sheet discharge end;

(c) once a first job of sheets having a first length in the sheet feeding direction has been stacked on the stack conveyor, moving the stack conveyor in the conveyor direction from a first position, where the first job has been stacked, to a second position, where a second job has to be stacked;

(d) stacking the second job in an intermediate position on the first job;

(e) repeating steps (c) and (d) until the stack is completed;

(f) evacuating the stack from the stack conveyor by moving the stack, preferably according to the conveyor direction.

While according to step (c) the stack conveyor moves from the first position to the second position in the sheet feeding direction, the sheet discharge end is preferably maintained in approximately the same position along the sheet feeding direction. This avoids the need to horizontally translate the sheet conveyor arrangement and the discharge end thereof, thus making the structure and control of the sheet conveyor arrangement much simpler.

As understood herein, stacking a second job in an intermediate position on the first job means that the longer one of the two superimposed first and second jobs projects from the shorter one of the two jobs on both sides thereof in the sheet feeding direction, i.e. in the conveyor direction. In this way, the job which has the longer dimension in the sheet feeding direction extends on both the leading side and the trailing side from the shorter job.

The two superimposed jobs can be positioned in a centered position, i.e. such that the distance between the respective leading edges or leading sides is substantially identical to the distance between the respective trailing edges or trailing sides of two superimposed jobs. "Substantially identical" as used herein may be understood as distances having a difference of less than approximately 5%, preferably less than approximately 3%. Centered jobs are thus jobs which are placed one on top of the other with the respective centerlines coinciding one with the other. This, however, is not mandatory. The distances between leading edges or leading sides and between the trailing edges or trailing sides can differ from one another, e.g. by about 50% or less, e.g. by about 20% or less, or by about 10% or less.

The possibility is also not excluded that in one stack two or more jobs have the trailing edges or the leading edges aligned to one another in the sheet feeding direction, if this is expedient from a point of view of job arrangement in the stack.

According to some embodiments, the step of evacuating the stack from the stack conveyor can comprise moving the stack from the stacker platform onto an evacuation conveyor located under the sheet conveyor arrangement.

According to embodiments disclosed herein, the method can further comprise the step of lifting the sheet discharge end from the top of the stack under formation when the stack under formation is moved by the stack conveyor towards the sheet discharge end to receive a further job.

Further features and exemplary embodiments of the invention are set forth in the annexed claims and in the following description.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS OF THE INVENTION

Figure 1:
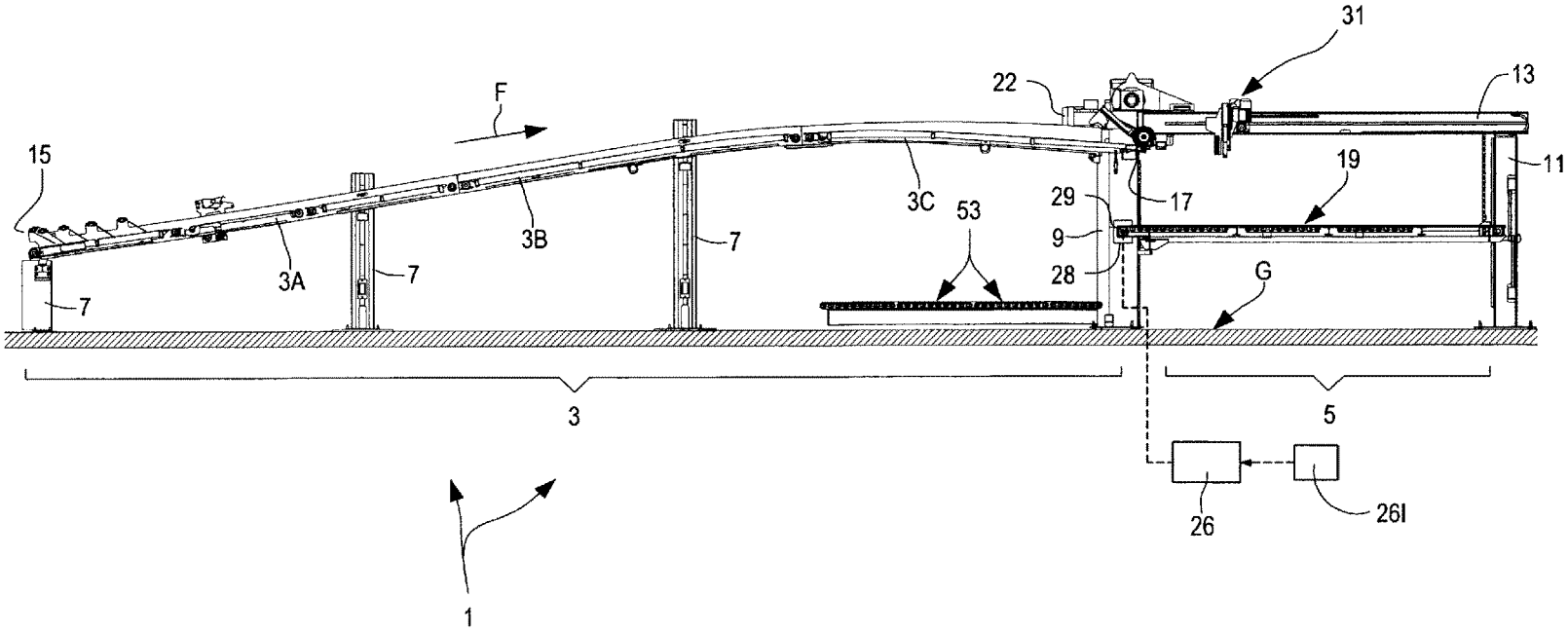
FIG. 1 illustrates a side view of a sheet stacker according to the invention.

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

For a better understanding of the method according to the present disclosure and of the many advantages thereof, current art methods will first be described, reference being made to FIGS. 7A, 7B and 8A, 8B.

In FIGS. 7A, 7B, 8A, 8B, a stacker 100 is schematically shown. Stacker 100 comprises a sheet conveyor arrangement 101, which feeds sheets C, for instance corrugated board sheets C, towards a stacking bay 103. The sheet conveyor arrangement 101 comprises a sheet discharge end 102, where a top roller 104 and a bottom roller 106 form a sheet discharge nip 108, wherefrom the sheets C are discharged onto a stacker platform 107. A stack conveyor 109 is supported by the stacker platform 107. The stack conveyor 109 is configured to move according to a conveyor direction which is orthogonal to the FIGS. 7A, 7B, 8A, 8B. The stacker platform 107 is movable vertically according to arrow f107 along a stationary structure 105. A stop plate 111 extends downwards from a carriage 113 which can move along a cross-beam 115 according to double arrow f113. The stop plate can be movable vertically according to double arrow f111.

Figure 7A:
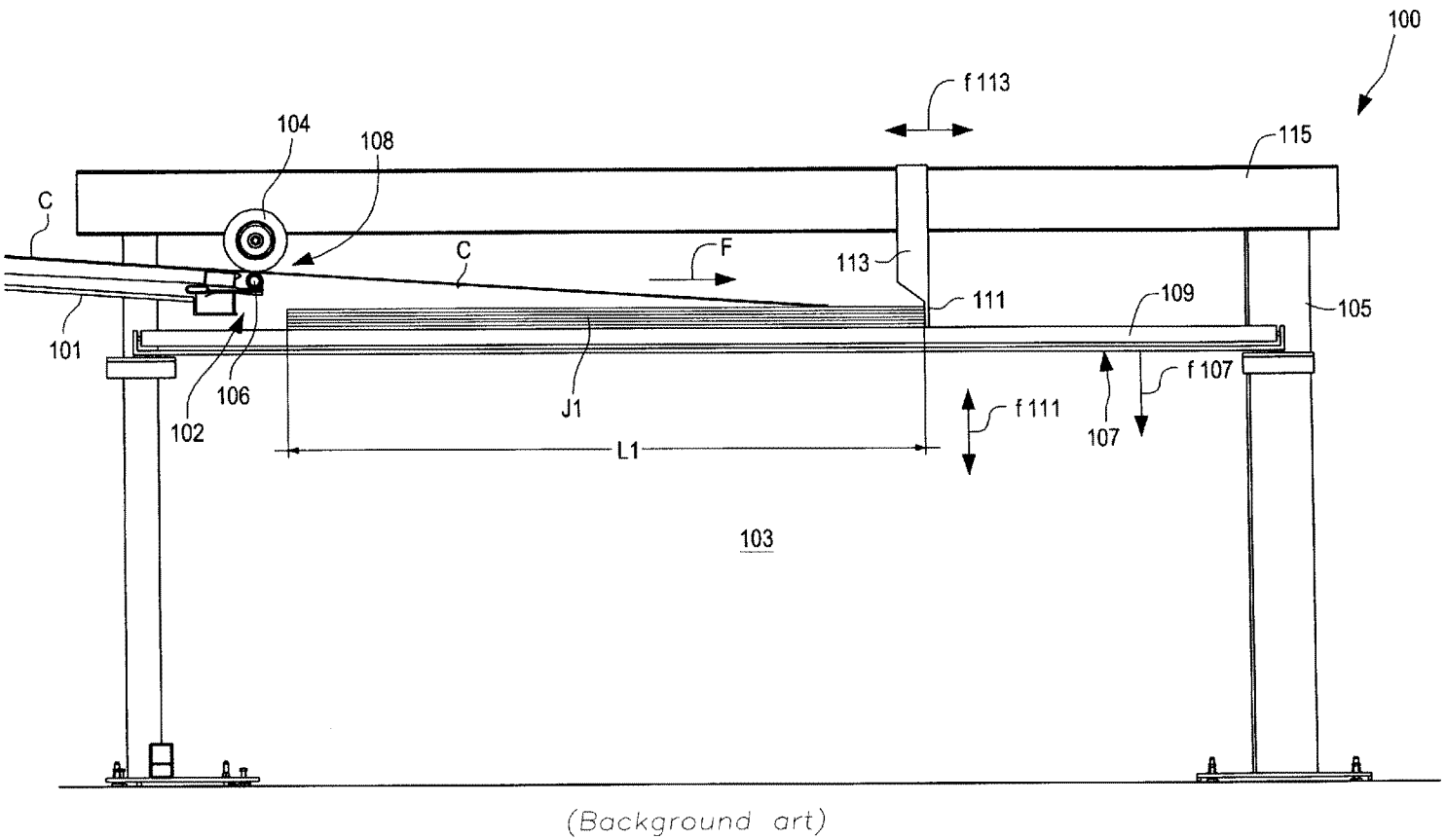
FIGS. 7A, 7B and 8A, 8B illustrate methods for forming stacks of superimposed jobs according to the current art.
Figure 7B:
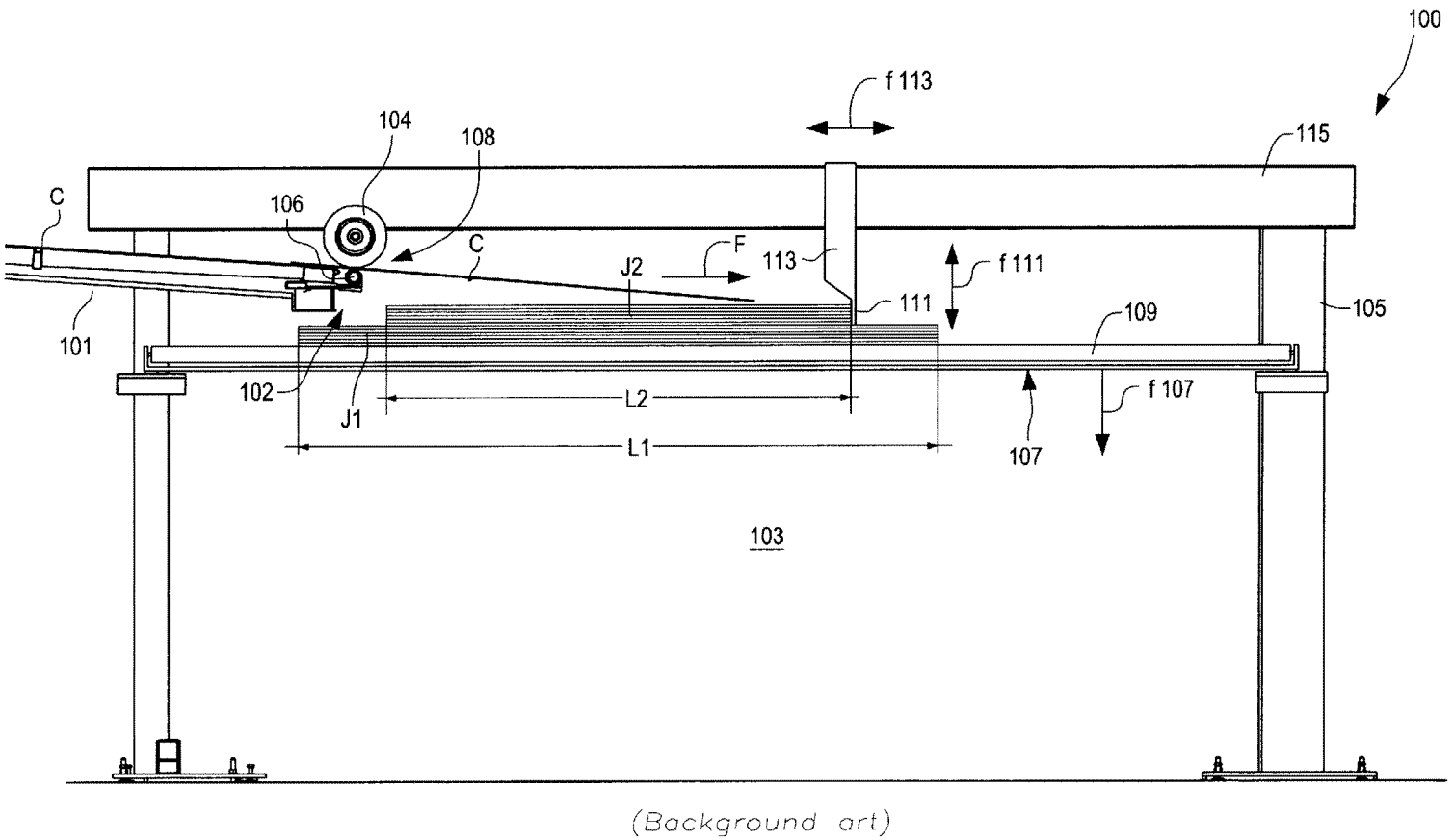
(Background art) Fig.7(B)

Referring now to the embodiment of FIGS. 7A, 7B, in FIG. 7A a stack of sheets C is being formed on stacker platform 107. These sheets have a length L1 in the sheet feeding direction F, which is orthogonal to the conveyor direction. A first job of sheets shall be formed on stacker platform 107. This first job is labeled J1 in FIGS. 7A, 7B. The job J1 is the first of a series of jobs to be stacked in the same stack being formed on the stacker platform 107. While the number of sheets in job J1 increases, the stacker platform 107 is lowered and therefore gradually distanced from the sheet discharge end 102 of the sheet conveyor arrangement.

Since the number of sheets forming job J1 is relatively small, in order to save space in the converting and transporting lines downstream of the sheet stacker 100, at least a second job J2 and possibly more than two jobs J1, J2 are stacked one on top of the other in the same stack. In FIG. 7B formation of the first job J1 has been terminated and a second job J2 is being formed on top of the first job J1. The length of the sheets forming the second job J2, in the sheet feeding direction F is shown at L2 and in this example is shorter than L1. In other operating conditions L2 might be larger than L1. A subsequent job may be stacked on top of the second job J2, and so on, until the full stack has been formed.

For example, the stack can be formed by a variable number of jobs, which may depend inter alia upon the length of the sheets of the various jobs in direction F and upon the height (vertical dimension) of the jobs.

In order to have a more stable stack, each job J(n) is centered with respect to the previous job J(n−1). This requires adjustment of the position of the stop plate 111 according to double arrow f113 and adjustment of the position of the sheet discharge end 102, and therefore of the entire sheet conveyor arrangement 101, as can be understood by comparing FIGS. 7A and 7B.

Once the stack has been completed, the stack conveyor 109 evacuates the stack according to a horizontal evacuation motion in a direction orthogonal to arrow F (sheet feeding direction).

In the example shown in FIGS. 7A, 7B the second job J2 is shorter than the first job J1 (L1<L2) such that the first job projects on both the trailing side and the leading side from the second job. In other situations, the opposite may occur, whereby the second (or subsequent) job may overhang on both sides from first (or previous) job in the direction F. By centering sequentially arranged jobs each job can overhang or project from the contiguous ones from both sides, which renders the stack more stable and easier to move. However, centering requires complex adjustment operations, especially inasmuch the sheet conveyor arrangement 101 is concerned.

Figure 8A:
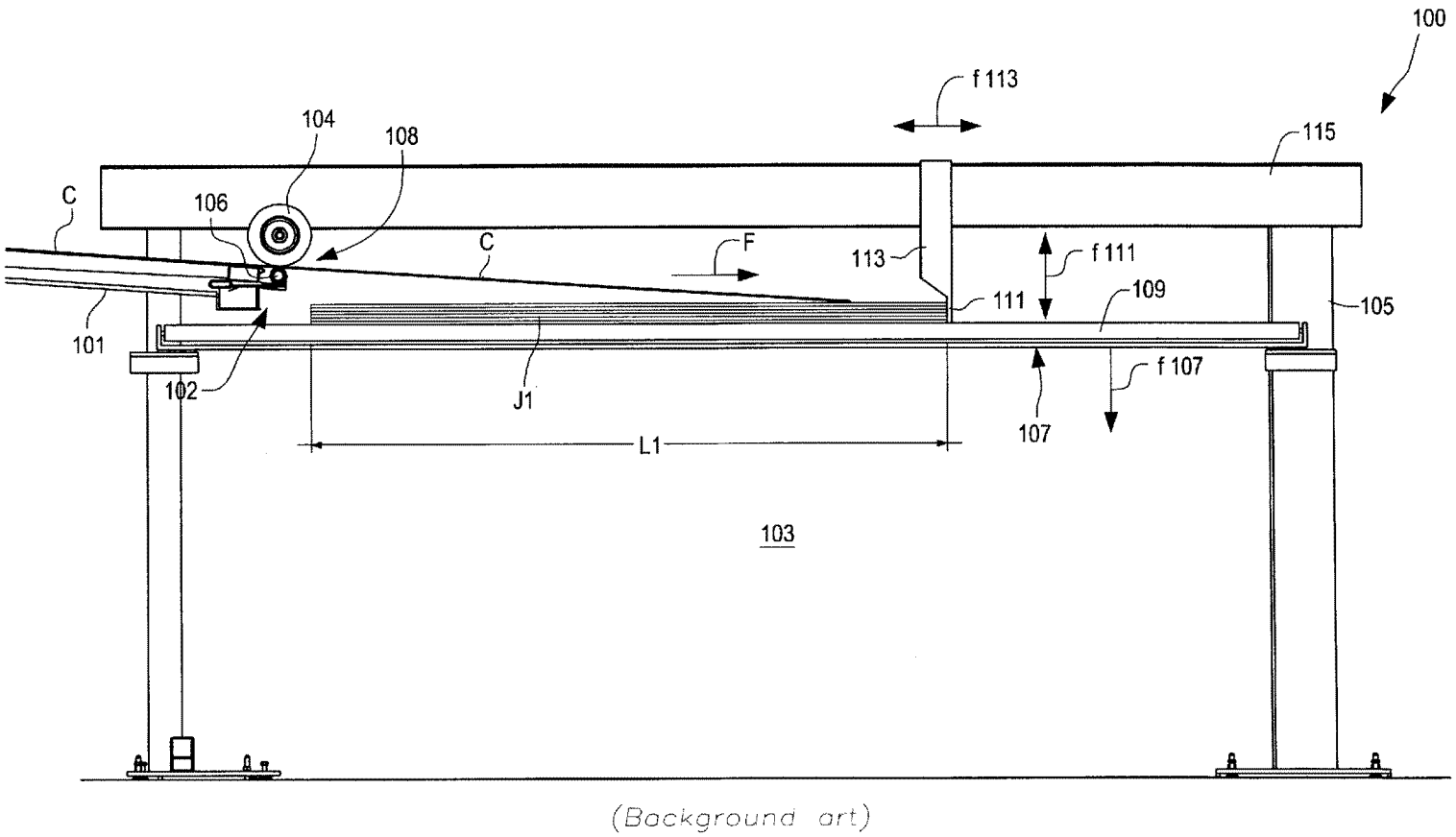
(Background art) Fig.8(A)
Figure 8B:
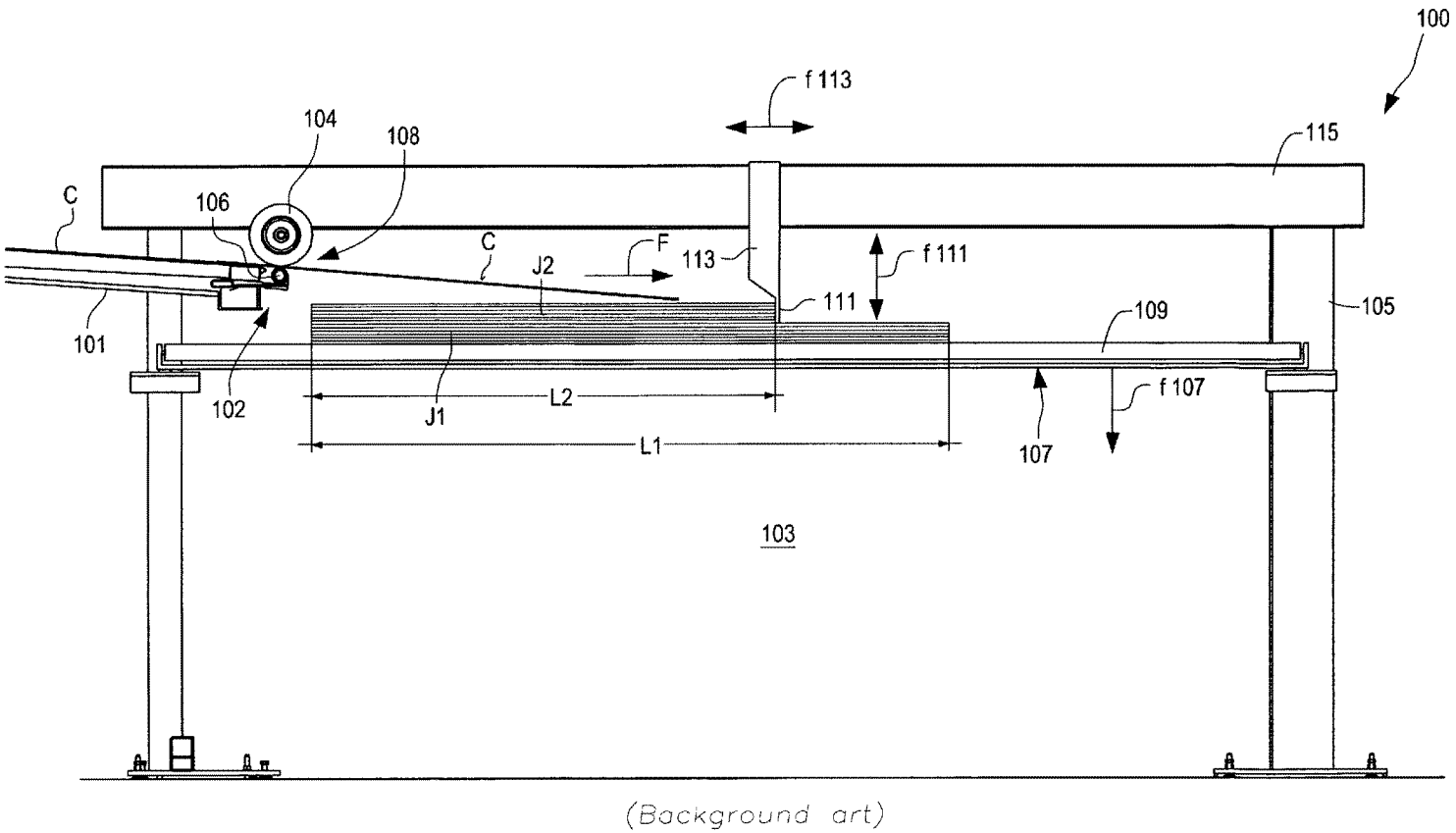
(Background art) Fig.8(B)

In order to make the adjustments easier, according to other known stacking methods, the sequentially formed jobs J1, J2, . . . J(n−1), J(n) are not centered one with respect to the other, but rather aligned along the most upstream edge thereof, as shown in FIGS. 8A, 8B. This can be achieved by keeping the sheet conveyor arrangement in a substantially stationary position. The stack formed by the superimposed jobs is less stable and/or less difference in job length (L1, L2) is tolerated in this case.

Embodiments of sheet stackers and of stacking methods according to the present disclosure alleviate at least some of the limitations of the above mentioned methods of the current art.

Referring now to FIG. 1, a sheet stacker 1 for the formation of stacks of sheets is globally labeled 1. The sheet stacker 1 comprises a sheet conveyor arrangement 3 and a stacking bay 5. According to some embodiments, as shown in FIG. 1, the sheet conveyor arrangement 3 comprises a plurality of sequentially arranged sheet conveyors 3A, 3B, 3C, which define a sheet delivery path. Each sheet conveyor 3A-3C can be comprised of one or more endless flexible members, such as belts or the like, which are entrained around idle and motor-driven rollers to advance the sheets towards the stacking bay 5. The sheet conveyor arrangement 3 can be supported by a stationary supporting structure comprised of uprights 7, 9. The stationary supporting structure can further include uprights 11 and a cross member 13 surrounding the stacking bay 5.

The sheet conveyor arrangement 3 has a sheet inlet side 15 and a sheet discharge end 17. Sheets, e.g. corrugated board sheets coming from a slitter-scorer or other upstream section (not shown) of the manufacturing line, enter the sheet conveyor arrangement 3 at the sheet inlet side 15 and are advanced according to a feeding direction F towards the sheet discharge end 17, where the sheets are discharged in the stacking bay 5 to form stacks of sheets as will be described later on.

Figure 2:
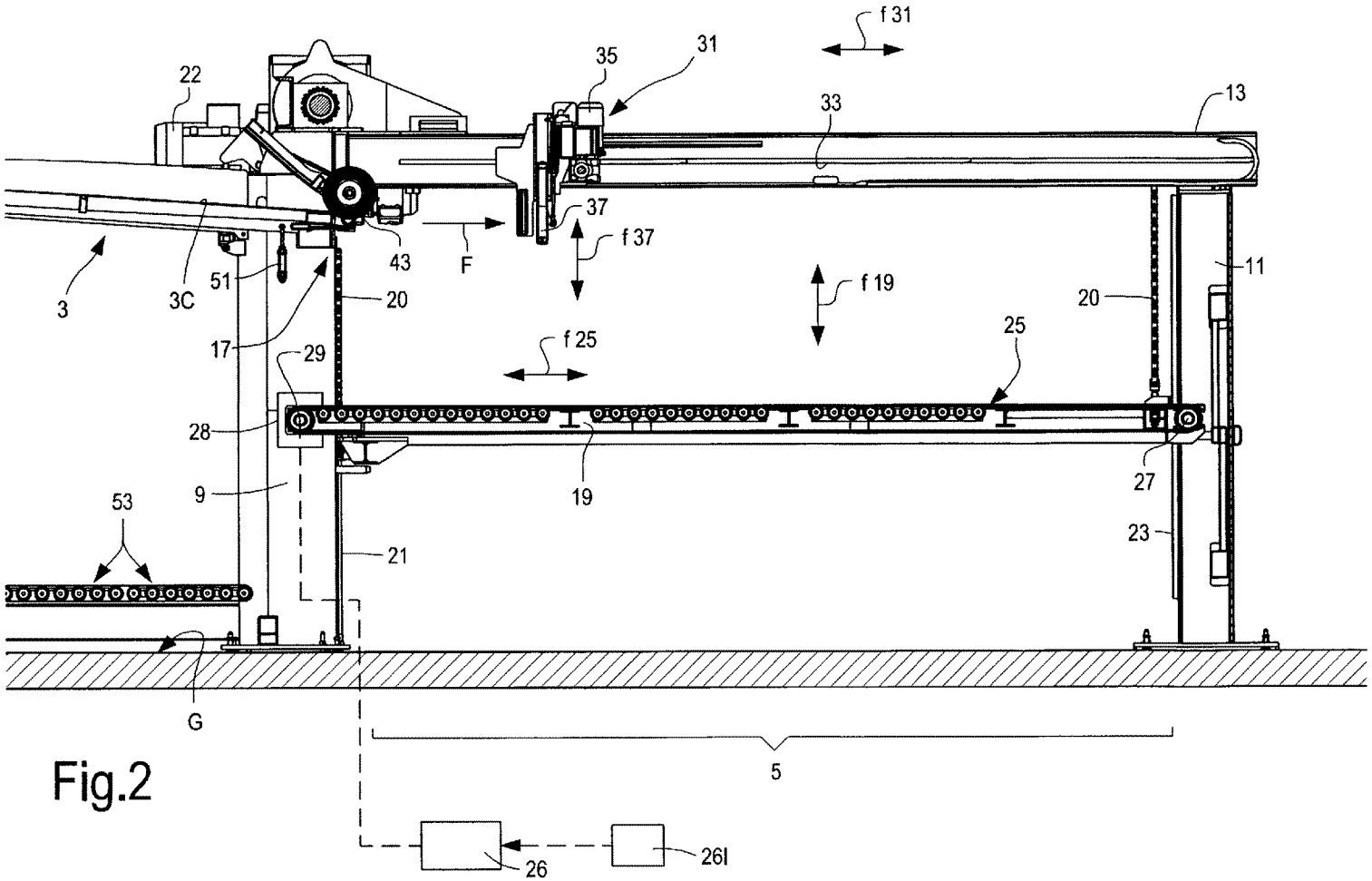
FIG. 2 illustrates an enlargement of the sheet stacker of FIG. 1, showing the sheet discharge end of the sheet conveyor arrangement and a stacking bay.

Referring now to FIG. 2, with continuing reference to FIG. 1, the stacking bay 5 comprises a stacker platform 19 which can move vertically up and down according to arrow f19. The stacker platform 19 can be supported by chains 20, or other lifting members, which are acted upon by an electric motor 22 to move the stacker platform 19 in a vertical up-and-down direction according to double arrow f19. The stacker platform 19 can be vertically guided by guides 21, 23 formed on uprights 9, 11. As shown in FIGS. 1 and 2 the stacker platform 19 supports a stack conveyor 25. The latter can be comprised of one or more endless flexible members entrained around rollers 27, 29, one of which at least is motor-driven, while the other can be idle.

The stack conveyor 25 is controlled to move back-and-forth in a substantially horizontal conveyor direction f25, parallel to the stacker platform 19 and approximately parallel to a feeding direction F according to which the sheets enter the stacking bay 5. This direction will be referred to herein also as the conveyor direction.

It shall be understood that the actual feeding direction F of the sheets upon leaving the sheet conveyor arrangement 3 can be inclined to some extent with respect to the horizontal direction, such that the sheet feeding direction F can have an upwardly or downwardly oriented speed component when the sheets first enter the stacking bay 5. However, the sheets enter the stacking bay 5 according to a direction F which lays in a vertical plane parallel to FIGS. 1 and 2 and thus parallel to the conveyor direction f25. The sheets will be stacked, i.e. piled up on the stacker platform 19 in a horizontal direction. Thus the feeding direction of the sheets in the final portion of the feeding path is generally horizontal and generally parallel to the direction conveyor direction f25, i.e. the direction of motion of the stack conveyor 25.

Along the cross member 13 a carriage 31 can be slidingly mounted. The carriage 31 can move along guides 33 according to double arrow f31 under the control of a motor 35, e.g. through a rack-and-pinion transmission system or the like. The carriage 31 supports a stop plate 37 which can extend in a general vertical direction. The stop plate 37 can move vertically up and down according to double arrow f37 under the control of a suitable actuator, such as a cylinder-piston actuator 38, an electric or hydraulic motor, or the like.

Figure 3:
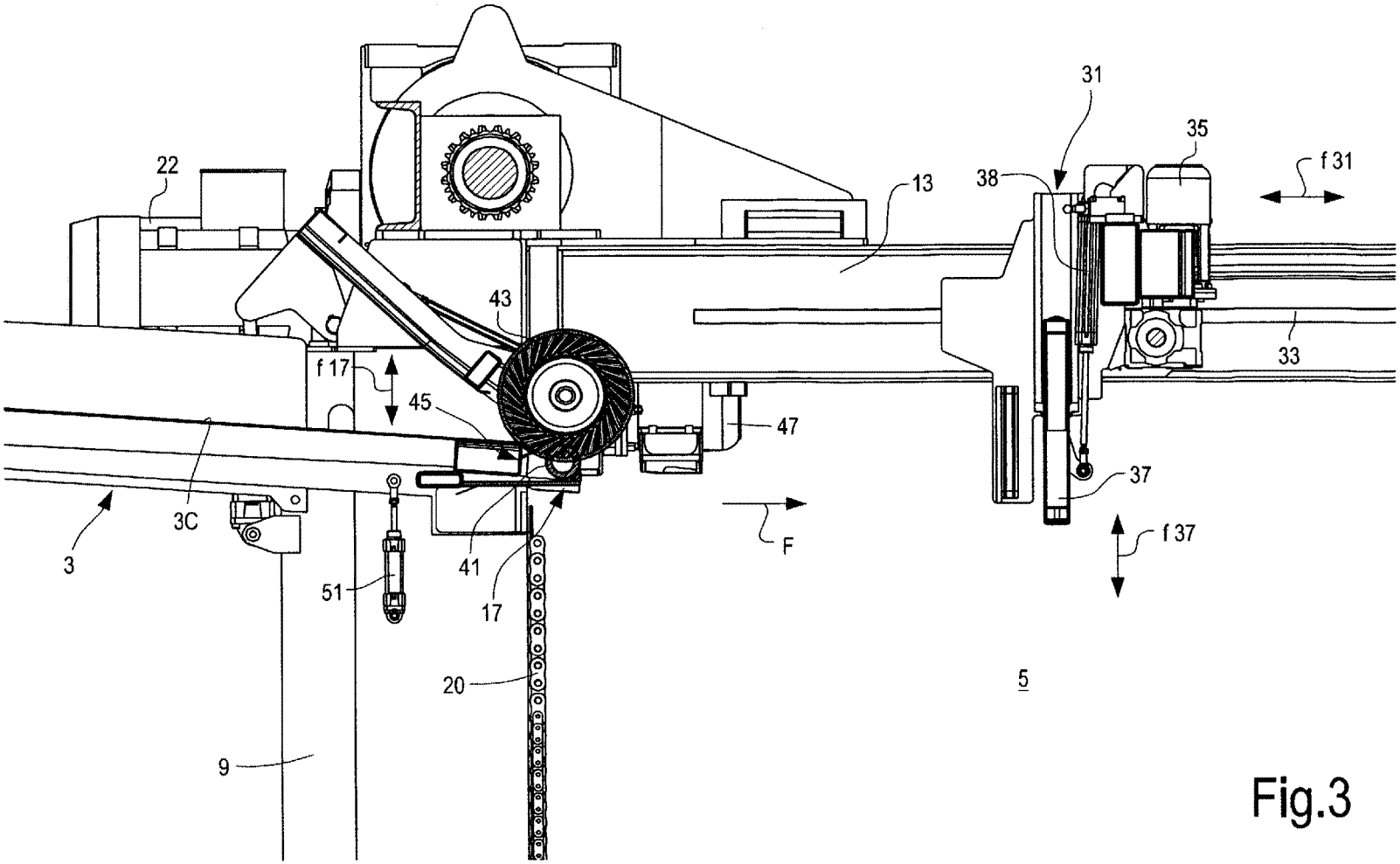
FIG. 3 illustrates an enlargement of the sheet discharge end of the sheet conveyor arrangement.

Referring now to FIG. 3, with continuing reference to FIGS. 1 and 2, according to some embodiments, the sheet discharge end 17 of the sheet conveyor arrangement 3 can comprise, in a manner known to those skilled in the art, a bottom roller 41 and a top roller 43, which define in combination a sheet discharge nip 45, where through the sheets conveyed by the sheet conveyor arrangement 3 are discharged in the stacking bay 5. The bottom roller 41 can be a motorized roller which controls the movement of the most downstream conveyor 3C of the sheet conveyor arrangement 3. Reference number 47 designates by way of example an electric motor which controls the motion of the most downstream conveyor 3C through rotation of the bottom roller 41.

The sheet discharge end 17 of the sheet conveyor arrangement 3 can be movable in a vertical direction according to double arrow f17, e.g. under the control of a linear actuator, such as a cylinder-piston actuator schematically shown at 51, for the purpose which will become clear from the description of the sequence of operations shown in FIGS. 4(A)-4(F).

Turning now back to FIG. 1, under the last portion of the sheet conveyor arrangement, an evacuation conveyor 53 can be arranged, which can be positioned near the ground level G.

The operation of the sheet stacker described so far will now be described with reference to the sequence of FIGS. 4(A)-4(F), where the main components of the sheet stacker are shown in different steps of a stacking cycle. A stack S of sheets is formed which is comprised of a series of superimposed jobs J1, J2, J3. The three jobs may have the same height (vertical dimension), or different heights, depending upon the number of sheets and the thickness of the sheets in each job.

Each job can differ from the previous job and subsequent job by the length L1, L2, L3 of the respective sheets C according to the sheet feeding direction F.

While the sequence of FIGS. 4(A)-4(D) is limited to three jobs J1, J2, J3, those skilled in the art will understand that a stack S can comprise more than just three jobs formed one on top of the other. This is schematically shown in the last FIGS. 4(E) and 4(F) illustrating by way of example a complete stack S comprised of five jobs J1-J5. In other embodiments, a different, e.g. larger or smaller number of jobs can be provided.

Additionally, the job sequence can be optimized in order to have a more stable stack. For instance, the length L of the superimposed jobs can be generally decreasing from the bottom to the top of the stack S. However, since other manufacturing constraints may have to be taken into consideration, the length L of the sequentially arranged jobs may not decrease constantly from the bottom toward the top of the stack, as schematically shown in FIG. 4(D), wherein the third job J3 has a length L3 according to the sheet feeding direction, which is larger than the length L2 of the previous job J2

During stacking of each job, the stop plate 37 is located at a distance from the sheet discharge end 17 of the sheet conveyor arrangement 3, which is determined by the sheet dimension L1, L2, L3 of each respective job in the direction F. In this way, each corrugated board sheet C delivered into the stacking bay 5 will advance until reaching the stop plate 37, and all the sheets C will thus be aligned with their most advanced edges (leading edges) abutting against the stop plate 37.

Figure 4A:
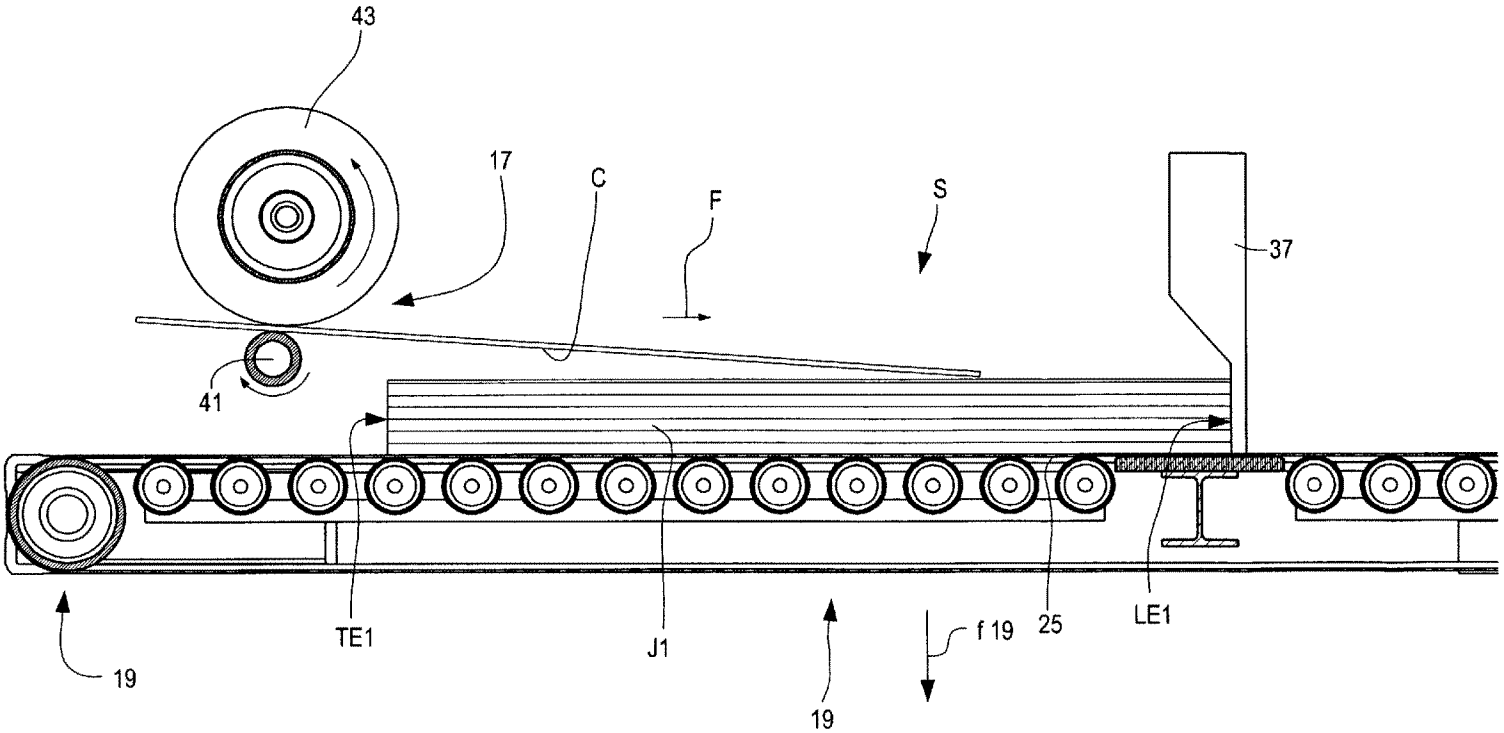
FIGS. 4(A)-4(F) illustrate a sequence of steps of a stack-forming cycle wherein several jobs are arranged in the same stack.

In FIG. 4(A) the first job J1 is being stacked on the stack conveyor 25. The stop plate 37 is at a distance from the nip 45 formed by rollers 41, 43, such that the sheets C, which have a length L1 according to the sheet feeding direction F, abut against the stop plate 37 and are neatly stacked one on top of the other. As the stack grows in height, the stacker platform 19 is gradually lowered (see arrow f19), such that the sheet discharge end 17 of the sheet conveyor arrangement 3 can remain substantially stationary.

Figure 4B:
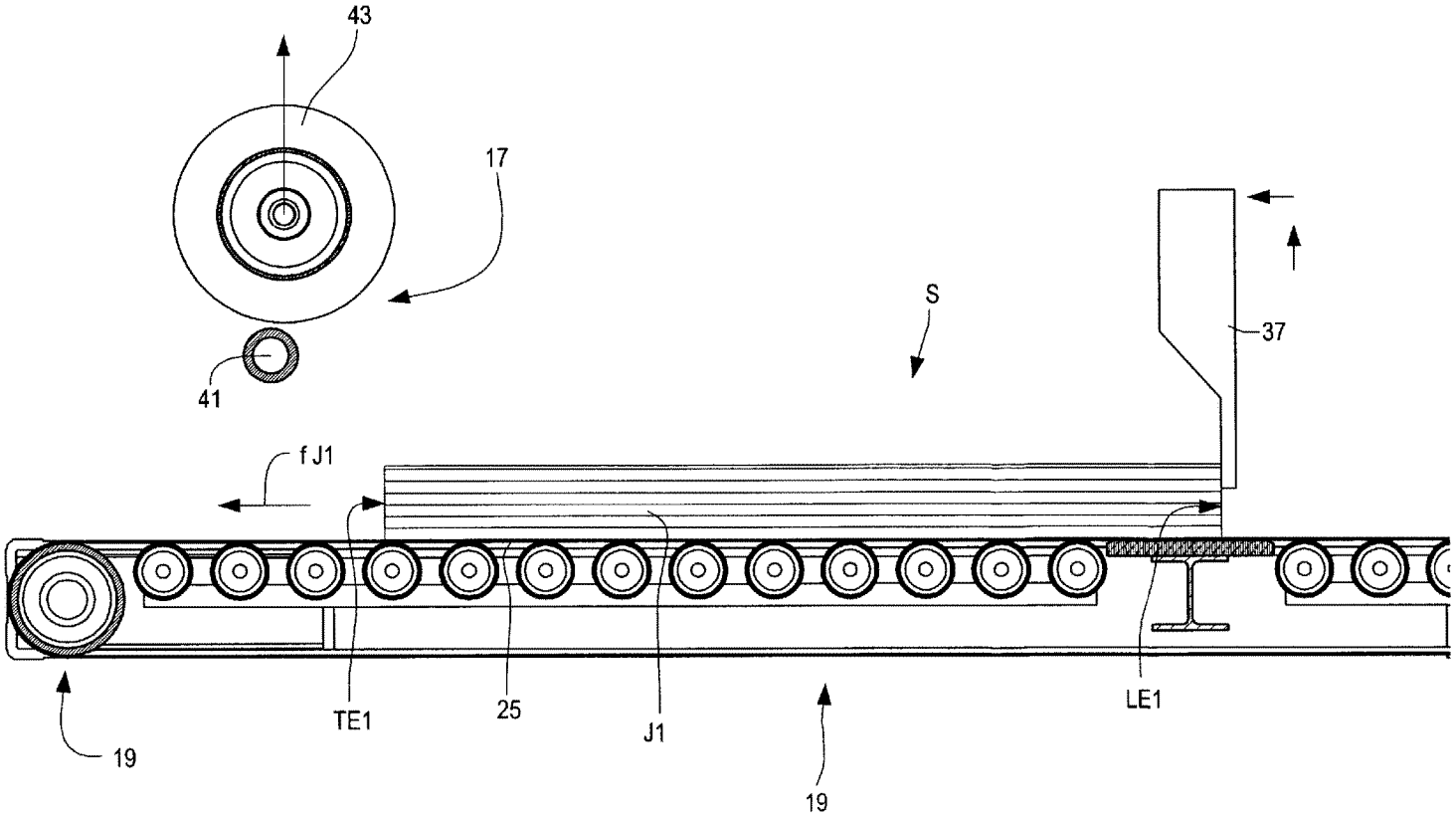

In FIG. 4(B) stacking of the first job J1 is terminated. The next job J2 is shorter (L2<L1). In order to superimpose the second job J2 in an approximately centered position onto the first job J1, the first job J1 is shifted from the right to the left (in the drawings), i.e. towards the sheet conveyor arrangement 3, in a direction parallel to but opposite to the sheet feeding direction F, see arrow FJ1. This motion is imparted by the stack conveyor 25 which is moved according to the conveyor direction. The stop plate 37 is lifted and moved towards the left as well (see arrows in FIG. 4(B)).

Figure 4C:
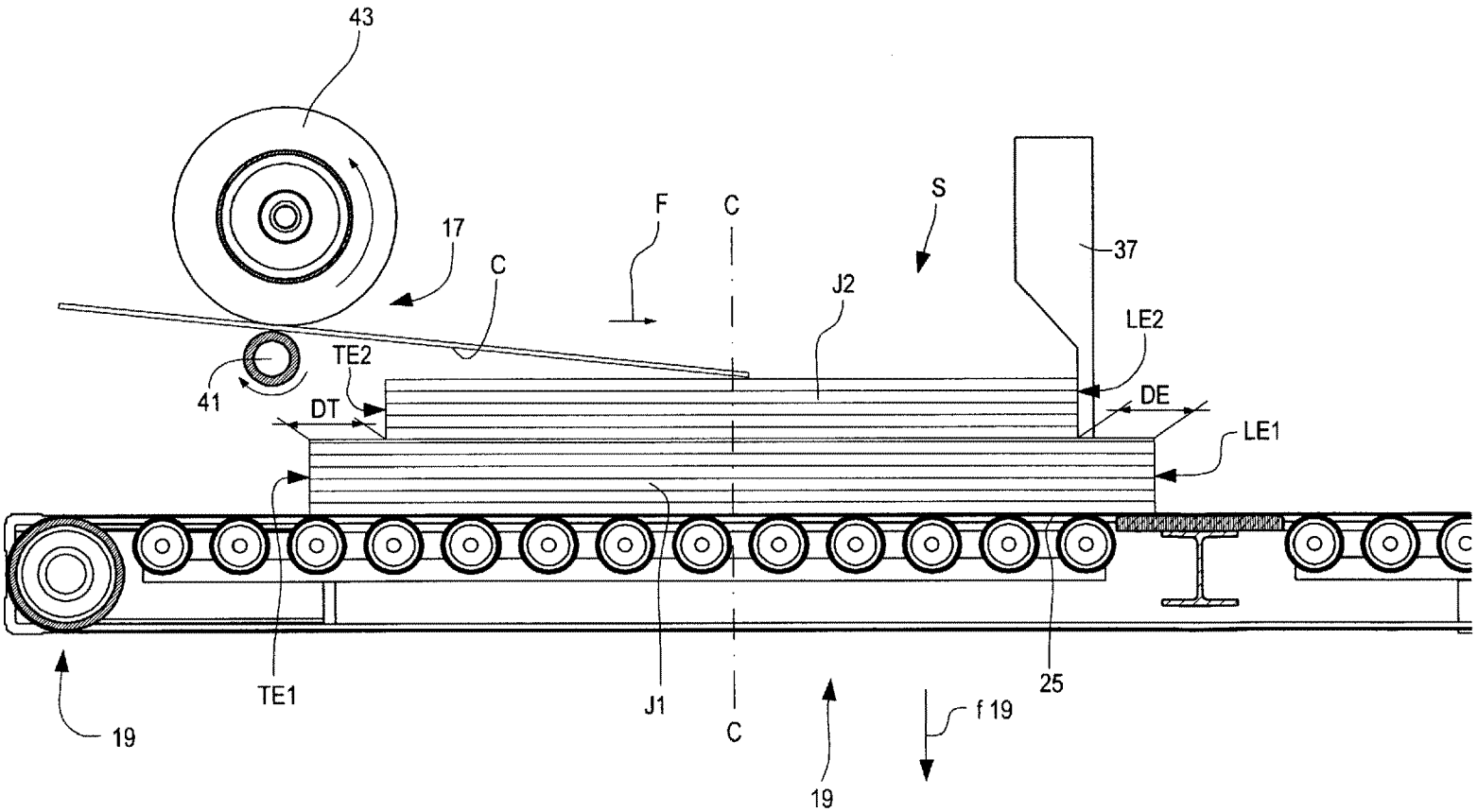
Figure 4D:
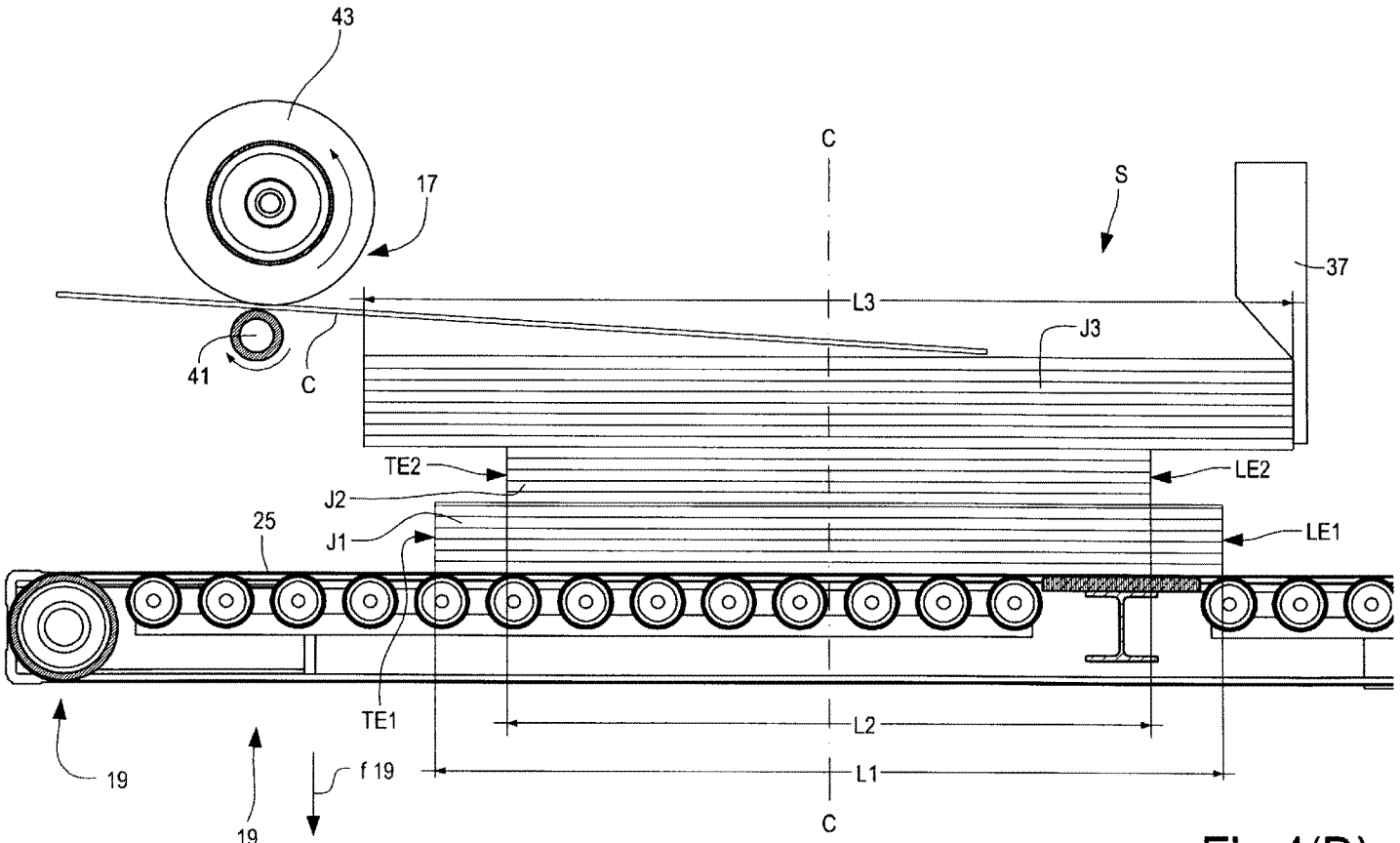
Figure 4E:
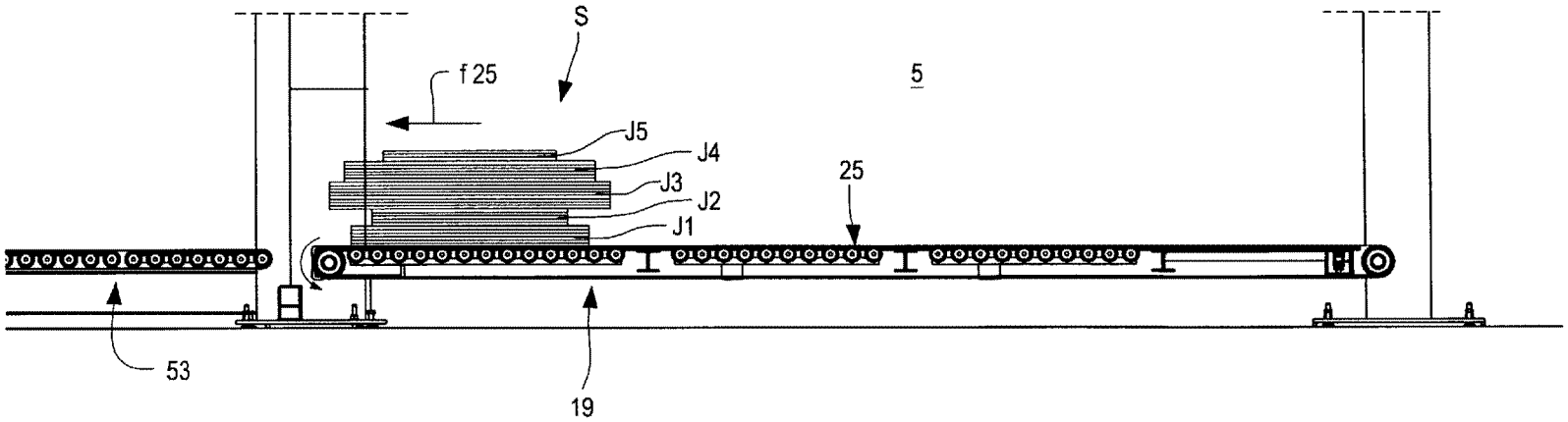
Figure 4F:
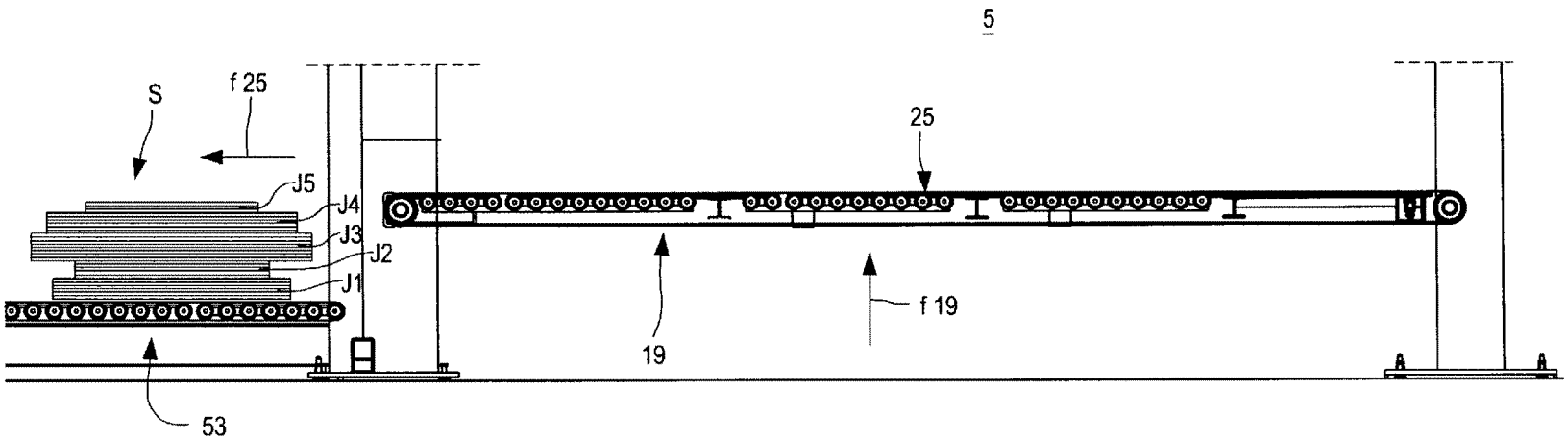

In the next FIG. 4(C) the next job J2 has started to form onto the previous job J1. The above described positioning movements cause the next job J2 to be substantially centered with respect to the previous job J1. In FIG. 4(C) the center line of job J2 is coincident with the center line of job J1. The center line is shown at C-C in FIG. 4(C) and is the line which divides the sheets of the job in the middle along the sheet feeding direction F.

It shall be understood that centering jobs one with respect to the other, such that the respective center lines coincide with each other, is not strictly necessary. Two jobs may not be exactly centered, but just arranged such that the trailing and leading edges of two subsequent jobs are not aligned to one another. As used herein "centered" may be understood to mean that the shorter job (here job J2) is arranged in a position intermediate the leading and trailing edges (in the sheet feeding direction F) of the longer job (here job J1), such that the longer job projects beyond the shorter job on both the trailing side and the leading side, i.e. upstream and downstream with respect to the sheet feeding direction F.

In FIGS. 4(A)-4(F) the trailing edge or trailing side of each $i^{-th}$ job Ji is labeled TEi, while the leading edge or leading end of each $i^{-th}$ job Ji is labeled LEi. For instance, TE1 and LE1 in FIG. 4(A) are the trailing edge, also referred to herein as the "trailing side", and the leading edge, also referred to herein as the "leading side", of the first job J1, respectively. In the embodiment illustrated in FIGS. 4(A)-4(F) each job is centered with respect to the previous and to the next job, such that the distance between the trailing edges of two adjacent jobs is substantially identical to the distance between the leading edges of said two jobs. For instance, referring to FIG. 4(C), the distance DT between the trailing edges TE1, TE2 of jobs J1 and J2 is substantially identical to the distance DL between the leading edges LE1, LE2 of said jobs J1 and J2. The sum DT+DL is the difference between the dimensions of the two jobs according to the sheet feeding direction F.

Once job J2 has been completed, a subsequent job J3 can be processed. As shown in FIG. 4(D) the sheets of the third job J3 have a length L3 according to the sheet feeding direction F. The length L3 is larger than the length L1 and L2 of both the first job J1 and the second job J2. In order to accommodate the third job J3 on top of the second job J3 in such a way that the third job J3 is centered with respect to the second job J2, i.e. such that the third job J3 overhangs on both sides of the job J3, the stack conveyor 25 is moved parallel and concordant to the sheet feeding direction F. Also the position of the stop plate 37 is adjusted by moving the stop plate 37 towards the right, i.e. away from the sheet discharge end 17 of the sheet conveyor arrangement 3.

During all the above described steps, the stacker platform 19 continuous to gradually move downwards (arrow f19) to accommodate the growing stack S of superimposed jobs J1, J2, J3.

Once the entire stack S has been completed, the stack S shall be evacuated on evacuation conveyor 53. This step is shown in FIGS. 4(E) and 4(F). In FIG. 4(E) the stacker platform 19 has been lowered and brought at the level of evacuation conveyor 53. By way of example only, the stack S is formed by five superimposed jobs J1, J2, J3, J4, J5. The stack conveyor 25 is now activated to move the stack S in the conveyor direction (arrow 125 in FIG. 4(E)) towards the evacuation conveyor 53. The conveyor direction 125 is now parallel to the sheet feeding direction F, but opposite thereto. In FIG. 4(F) the stack S has been transferred onto evacuation conveyor 53 and the stacker platform 19 can now be lifted again towards the sheet discharge end 17 of the sheet conveyor arrangement 3, to start formation of a next stack. Clearing of the stacker platform 19 is very fast.

The back-and-forth movement of the stack conveyor 25 according to the conveyor direction (double arrow f25) can be controlled by an actuator, such as an electric motor 28 (FIG. 1). The electric motor 28 can be under the control of a control unit 26, which may be functionally connected to or provided with one or more user interfaces 261. The sequence of jobs J1, J2, J3 . . . can be properly organized based on several parameters, among which the length L1, L2, L3 . . . of the respective sheets according to the sheet feeding direction F. An operator may input production parameters through the user interface 261, e.g. a keyboard, a touch-screen or the like. The control unit 26 may be programmed to choose the optimal job sequence. In other cases, the job sequence may be directly provided by the user.

If other constraints so permit, the jobs can be ordered such that the length thereof according to the sheet feeding direction F decreases from the bottom towards the top of the stack S. However, this may not always be expedient. It shall for instance be considered that more streams of sheets C are processed in parallel, such that more than one stack of sheets are formed at the same time on the stacker platform 19. The various stacks are aligned in a cross-machine direction, i.e. orthogonal to the sheet feeding direction F. The dimension of the sheets in the cross-machine direction, i.e. the transverse dimension of the sheets, may vary from one job to the other and from one stack to the other. The sequence of jobs may be designed depending upon the transverse dimension of the sheets, such that in some cases (as schematically shown in the sequence of FIGS. 4(A)-4(F)) longer sheets may require to be placed on top of shorter sheets.

Figure 5:
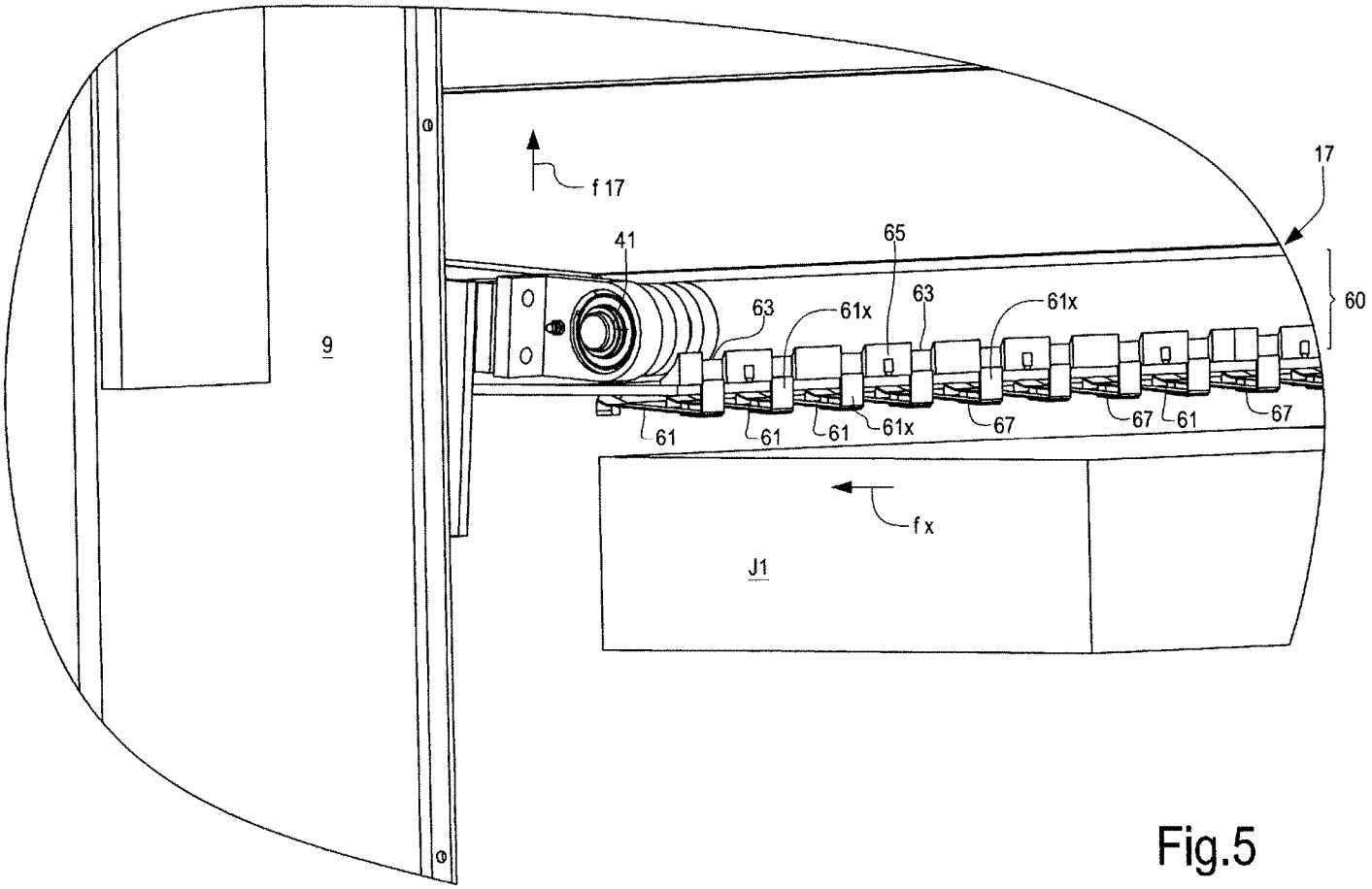
FIGS. 5 and 6 illustrate a detail of a job retaining device in two different operating positions.
Figure 6:
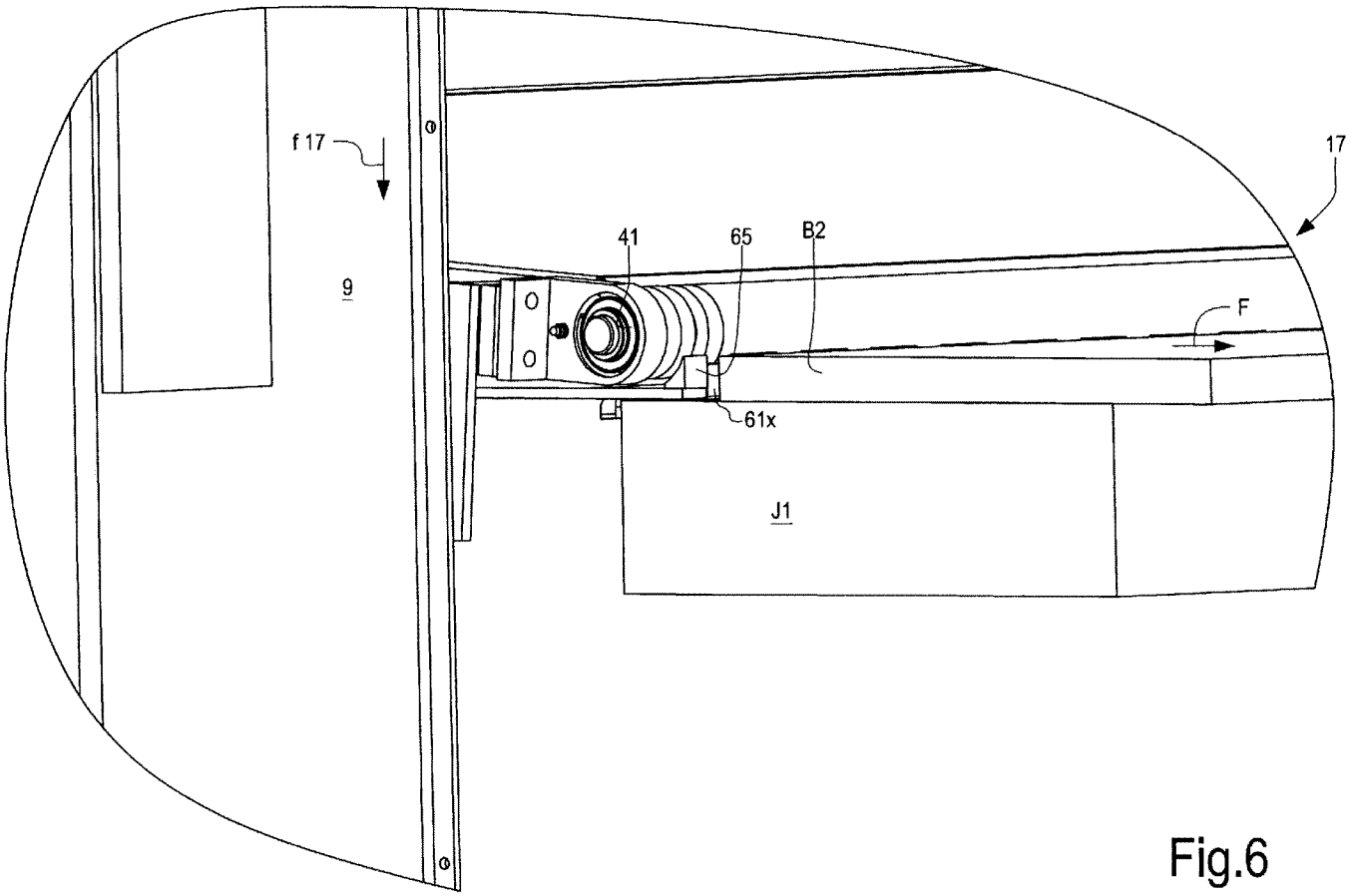

According to some embodiments, in order to ensure a correct piling up of the corrugated board sheets C and of the jobs J1, J2, . . . a job retaining device can be arranged at the sheet discharge end 17 of the sheet conveyor arrangement 3. FIGS. 5 and 6 illustrate details of the job retaining device, globally labeled 60. In some embodiments, the job retaining device 60 comprises one or preferably a plurality of resilient leaf blades 61, e.g. made of metal. The resilient leaf blades 61 form a sheet braking member, which prevents or reduces undesired displacements of the corrugated board sheets of the last formed job. In other embodiments, not shown, the job retaining device may include different kinds of resilient members, such as for instance rubber or foam pads or the like.

The resilient leaf blades 61 may each have a terminal bent appendage 61X, which form a surface facing the jobs J being formed. The appendages 61X can be housed in indentations 63 formed in a transverse bar 65, which can be arranged adjacent the bottom roller 41, around which the most downstream sheet conveyor 3C is entrained. The bottom of each resilient leaf blade 61 can be provided with a high-friction pad 67, e.g. made of natural or synthetic rubber, plastic material, synthetic foam material, or any other material suitable to apply a grip against the upper surface of the top-most job B, when the trailing edge thereof is moved under the bottom roller 41, i.e. under the sheet discharge end 17 of the sheet conveyor arrangement 3.

The operation of the job retaining device 60 can be best understood looking at FIGS. 5 and 6 with continuing reference to the sequence of FIGS. 4(A)-4(F). In FIG. 5 the sheet discharge end 17 of the sheet conveyor arrangement 3 has been lifted (arrow f17, FIG. 5) in the lifted position, in order to allow the stack under formation to move according to arrow fx, such that the last-formed job J1 is moved with the trailing edge thereof under the sheet discharge end 17. In this position the resilient leaf blades 61 project under the bar 65. Once the stack S has been displaced such that the job J1 is partly under the roller 41, i.e. the trailing edge of the job J1 is under the sheet discharge end 17, the latter can be lowered according to arrow f17 in FIG. 6, such that the high-friction pads 67 are pressed against the upper surface of the last sheet forming the job J1. Formation of the next job J2 can start, as shown in FIG. 6, with the trailing edges of the corrugated board sheets C, and thus the trailing edge of the job 2, abutting against the bar 65.

The corrugated board sheets C are fed according to arrow F and slide along the upper surface of the previously formed job J1. Friction between the corrugated board sheets C and the underneath job J1 could cause an undesired displacement of the last corrugated board sheets C of job J1 in direction F, dragged by the next corrugated board sheets C belonging to the next job J2. The pressure applied by the resilient laminar leafs 61 prevents the top corrugated board sheet of job J1 from moving in direction F. When the Job J2 has been completed, the lifting movement (arrow f17, FIG. 5) of the sheet discharging end 17 of the sheet conveyor arrangement 3 releases the job J1, allowing the stack S to move according to fx or fy as required.

While the above description concerns a mode of operation of the sheet stacker 1 for the formation of stacks S, each formed by staggered jobs J, the same sheet stacker can also produce stacks S containing sheets of one and the same job, i.e. having the same dimension. In this case the stack conveyor 25 will not shift the stack under formation until the complete stack is formed. At this time, the stack is evacuated as shown in FIGS. 4(E) and 4(F).

In the embodiments disclosed so far, the stacks S are cleared off the stacker platform 19 by means of a clearing movement according to an evacuation motion in a direction fE which is substantially parallel but opposite to the direction F of arrival of the corrugated board sheets C in the stacking bay 5. In such manner the stacks S are moved on the evacuation conveyor 53, which is located under the sheet conveyor arrangement 3. This is particularly beneficial in terms of processing time, since the time needed to clear the stacker platform 19 is reduced, thus improving the overall production rate of the sheet stacker 1. Moreover, since the evacuation conveyor 53 is arranged under the sheet conveyor arrangement 3, the overall footprint of the sheet stacker 1 is reduced. However, in less advantageous embodiments evacuation can be in the opposite direction, i.e. by moving the formed stack S of superimposed jobs J1, J2, J3 . . . according to a conveyor direction f25 concordant to the sheet feeding direction F.

If the stack conveyor 25 has a dual-motion capability, e.g. has means to move the stacks in two non-parallel directions, evacuation of the stacks can be performed in a direction transverse (preferably orthogonal) to the sheet feeding direction.

While the invention has been described in connection with what is presently considered to be the most practical and preferred examples, it is to be understood that the invention is not to be limited to the disclosed examples, but on the contrary, is intended to cove various modifications and equivalent arrangements included within the spirit and scope of the appended claims.

The invention claimed is:

1. A sheet stacker comprising:

a sheet conveyor arrangement, configured for feeding a plurality of sheets in succession towards a sheet discharge end of said sheet conveyor arrangement;

a stacker platform, whereon sheets delivered by the sheet conveyor arrangement are formed into stacks;

wherein the sheet discharge end and the stacker platform are provided with a mutual approaching and distancing movement;

a stack conveyor supported by the stacker platform, arranged to move according to a conveyor direction, wherein said conveyor direction is approximately parallel to a sheet feeding direction of the sheet discharge end in which said sheets are fed from the sheet discharge end onto the stacker platform;

a control unit programmable with machine parameters for providing a job sequence;

wherein the stack conveyor is adapted for horizontal movement on the stacker platform of a partially formed stack in said conveyor direction and vertical movement of the stacker platform by a lifting and lowering mechanism, which in combination with a job retaining device and a stop plate, said stop plate being adapted for movement along a stationary support structure arranged above said stacker platform, is structured and arranged to provide selective stoppage of sheets resulting in positioning of sequentially received sheets one onto another so that shorter sheets of one job are arranged in an intermediate position with respect to longer sheets of another job through coordinated movement controlled by said control unit of said stacker platform, said job retaining device and said stop plate.

2. The sheet stacker of claim 1, wherein said lifting and lowering mechanism is connected to a stationary supporting structure and is adapted for gradual movement downwards while a stack of sheets is formed thereon.

3. The sheet stacker of claim 1, wherein the stack conveyor is further adapted for evacuation motion in said conveyor direction to remove a stack from the stacker platform.

4. The sheet stacker of claim 3, further comprising an evacuation conveyor positioned under the sheet conveyor arrangement, and wherein said stack conveyor is arranged in relation to the evacuation conveyor so that a completed stack can move from the stacker platform onto the evacuation conveyor and be evacuated on the evacuation conveyor under the sheet conveyor arrangement.

5. The sheet stacker of claim 1, wherein the stack conveyor and the sheet conveyor arrangement are controlled by said control unit to receive sheets of variable lengths of sequential jobs in the sheet feeding direction in a manner that a job of longer sheets project from a job of shorter sheets on both sides of the stack in the sheet feeding direction, based on the job retaining device and the stop plate while the sheet discharge end is stationary.

6. The sheet stacker of claim 1, wherein the stop plate has a reciprocating vertical movement, which is synchronized with the motion of the stack conveyor in the conveyor direction to center sequentially superposed jobs of variable length on the same stack.

7. The sheet stacker of claim 1, wherein the sheet discharge end of the sheet conveyor arrangement is combined with an actuator, which controls a lifting and lowering movement of the sheet discharge end, said lifting and lowering movement of the actuator being synchronized with the motion of the stack conveyor in the conveyor direction to position sequentially superposed jobs of variable length.

8. The sheet stacker of claim 1, wherein the sheet discharge end is combined with the job retaining device, and is arranged for retaining a top-most job of a stack being formed when the stack conveyor performs a motion in a direction away from the sheet discharge end to position a subsequent job on a previous job.

9. A method of forming a stack of sheets comprising a plurality of superposed jobs; the method comprising as follows:

(a) feeding a plurality of sheets along a sheet conveyor arrangement towards a stacker platform, the sheet conveyor arrangement having a sheet discharge end, wherefrom the sheets are discharged onto the stacker platform in a sheet feeding direction and formed into a stack on a stack conveyor supported by the stacker platform; said stack conveyor being movable in a conveyor direction approximately parallel to the sheet feeding direction;

(b) while the sheet stack gradually grows on the stack conveyor, moving the stacker platform and the sheet discharge end gradually away from each other;

(c) once a first job of sheets having a first length in the sheet feeding direction has been stacked on the stack conveyor, moving the stack conveyor in the conveyor direction;

(d) stacking a second job in an intermediate position on the first job;

(e) repeating steps(c) and (d) until the stack is completed;

(f) evacuating the stack from the stack conveyor.

10. The method of claim 9, wherein said evacuation of the stack from the stack conveyor includes moving the stack in the conveyor direction.

11. The method of claim 9, wherein the intermediate position is a position wherein the second job and the first job are centered one with respect to another along the sheet feeding direction.

12. The method of claim 9, wherein said evacuation of the stack from the stack conveyor comprises moving the stack from the stacker platform onto an evacuation conveyor located under the sheet conveyor arrangement.

13. The method of claim 9, further comprising lifting the sheet discharge end from the top of the stack under formation on the stacker platform when the stack under formation is moved by the stack conveyor towards the sheet discharge end when the position of the stack is changed to receive the second job.

14. The method of claim 9, further comprising abutting the sheets coming from the sheet conveyor arrangement against a stop plate arranged above the stacker platform.

15. The method of claim 14, further comprising reciprocatingly moving the stop plate in a vertical direction in synchronism with the motion of the stack conveyor to position the second job with respect to the first job.

16. The method of claim 9, wherein the moving of the stacker platform and the sheet discharge end gradually away from each other comprises lowering the stacker platform with respect to a stationary structure.

* * * * *